US005494083A

United States Patent [19]

Elmore

[11] Patent Number: 5,494,083

[45] Date of Patent: Feb. 27, 1996

[54] UTILITY AIR TANK

[76] Inventor: Rickey L. Elmore, #16 C.R. 451, Princeton, Tex. 75407

[21] Appl. No.: 368,105

[22] Filed: Jan. 3, 1995

[51] Int. Cl.[6] ..... B65B 31/00

[52] U.S. Cl. ..... 141/19; 141/18; 141/329; 141/330; 141/65; 141/67; 141/197; 141/95; 128/205.21; 222/5; 222/81; 222/82

[58] Field of Search ..... 141/329, 330, 141/3, 197, 18, 19, 95, 38, 65, 67; 222/5, 81, 82; 128/205.21, 203.21; 604/70

[56] References Cited

U.S. PATENT DOCUMENTS 3,012,694 12/1961 Johnston ..... 128/205.21
3,051,356 8/1962 Kirby ..... 222/5
3,161,322 12/1964 Stone ..... 222/5
3,853,125 12/1974 Clark et al. ..... 604/70
4,969,493 11/1990 Lee ..... 141/329

*Primary Examiner*—J. Casimer Jacyna
*Assistant Examiner*—Timothy L. Maust
*Attorney, Agent, or Firm*—John E. Vandigriff

[57] ABSTRACT

The invention relates to a small utility air storage tank that includes a pressure gage and an air flow regulator. The storage tank may be used alone or in conjunction with a second storage for storing and supplying a larger amount of air for use with an airbrush or air blower. The storage tank and second storage tank may be filled with air from an air source. One of the storage tanks may be filled by discharging gas cartridges into the storage tank. An auxiliary tank may be attached to the storage tank for use in sand blasting or to create a vacuum.

17 Claims, 7 Drawing Sheets

UTILITY AIR TANK

FIELD OF THE INVENTION

This invention relates to air tanks, and more particularly to a utility air tank that can be attached to a person's belt.

BACKGROUND OF THE INVENTION

Various tanks are available, for example, for inflating tires from individual containers that supply sufficient air for a single tire. The containers come either prefilled with air, or are filled by a small cartridge that is mountable to the air container and discharged into the container to provide sufficient air to fill a tire.

U.S. Patent, issued Nov. 13, 1990, describes a manually-operated device for inflating an automobile tire. A pressurized gas cylinder is connected to a manual valve for delivery of pressurized gas to a vehicle tire.

U.S. Pat. No. 3,834,433, issued Sep. 10, 1974, utilizes a cartridge-actuated device for inflating tires and other objects. A $CO_2$ type cartridge is used to fill a container with pressurized gas that is used to inflate an inflatable object.

These and other patents related to singe-shot inflation devices, and have a single object of inflating a single inflatable object.

SUMMARY OF THE INVENTION

The invention relates to a small utility air storage tank that includes a pressure gage and an air flow regulator. The storage tank may be used alone or in conjunction with a second storage tank for storing and supplying a larger amount of air. The storage tank and second storage tank may be filled with air from an air source or may be filled by discharging gas cartridges into one of the storage tanks.

The storage tank may be used to supply air to an air brush, to a nozzle for blowing dust and debris, pressure checks, or to generate a vacuum for vacuuming small particles or a small amount of liquid. A compartment may be attached to the bottom of the storage tank to supply a small amount of sand which may be used for sand blasting small areas.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
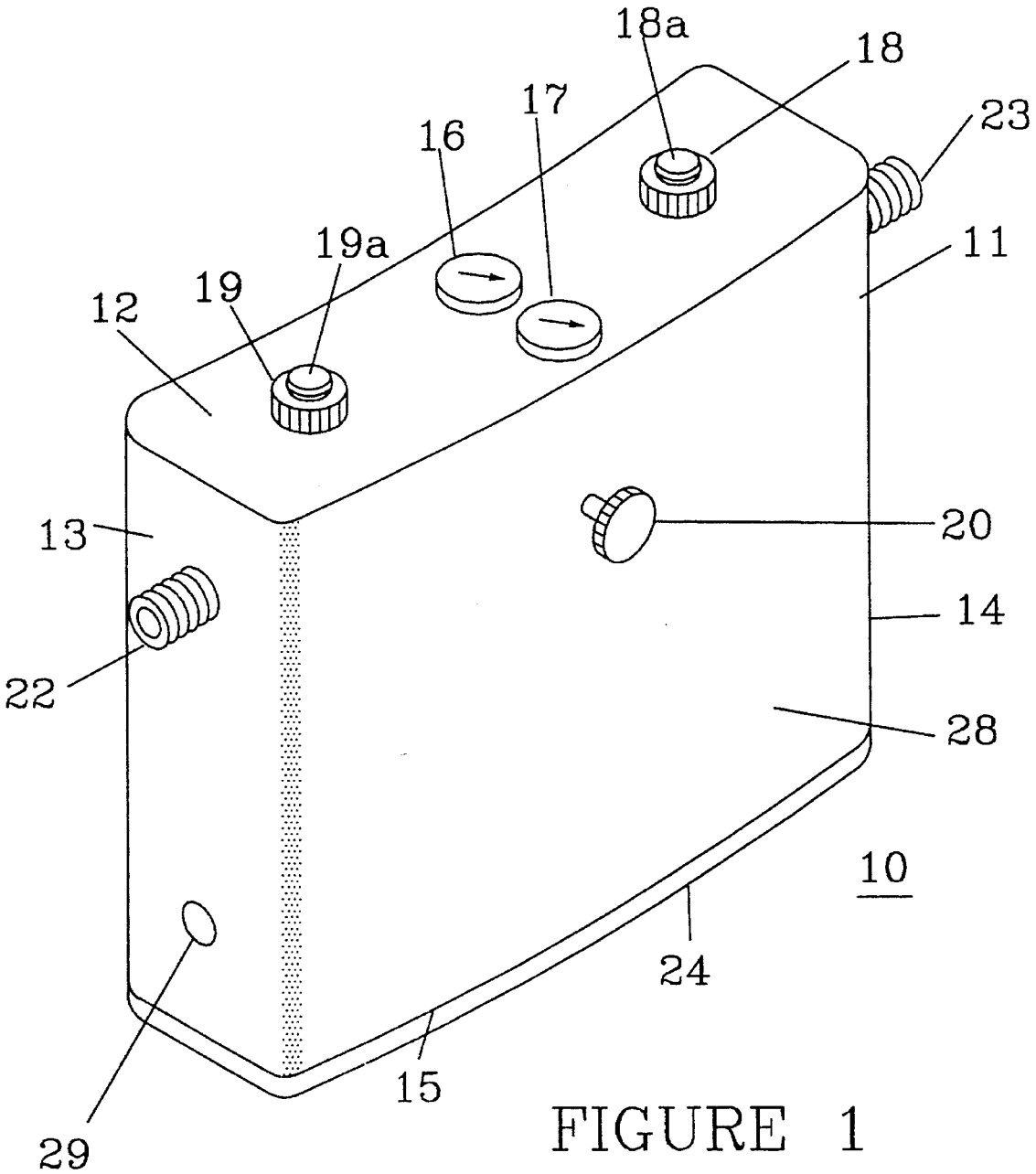
FIG. 1 is an isometric illustration of the utility air storage tank of the present invention.

FIG. 1 is an isometric illustration of a utility air storage tank 10 having a top side 12, a first side 13, a second side 14, a bottom side 15 and a front side 28. On first side 13 is an air inlet valve 22 for supplying air from an air source (not illustrated) to fill tank 10 with air. An air outlet 23 is on the second side of tank 10. The bottom side includes a cover plate 24 which is removable for attaching an addition compartment which is described below.

Top side 12 includes two gages 16 and 17. Gage 16 shows the air pressure inside tank 10, and gage 17 shows the outlet air pressure dispensed through outlet 23. The outlet pressure is set by a manual regulator with knob 20, located in front side 28.

On top 12 of tank 10 are two caps 18 and 19 which are removable to open two compartments into which gas cartridges (not illustrated) may be inserted. The gas cartridges remain in the compartments until needed. At that time either or both knobs **18*a* and 19*a* are pressed or screwed down to move the cartridge into contact with a puncture needle to release the gas in the cylinder into the air chamber in tank 10. Although air storage tank 10 has a theoretical test capacity of up to about 900 pounds per square inch (psi), a safety operating pressure would not exceed between 200 and 300 psi. A safety valve 29 is in side 13** to prevent the internal air pressure from exceeding a predetermined amount.

Figure 2:
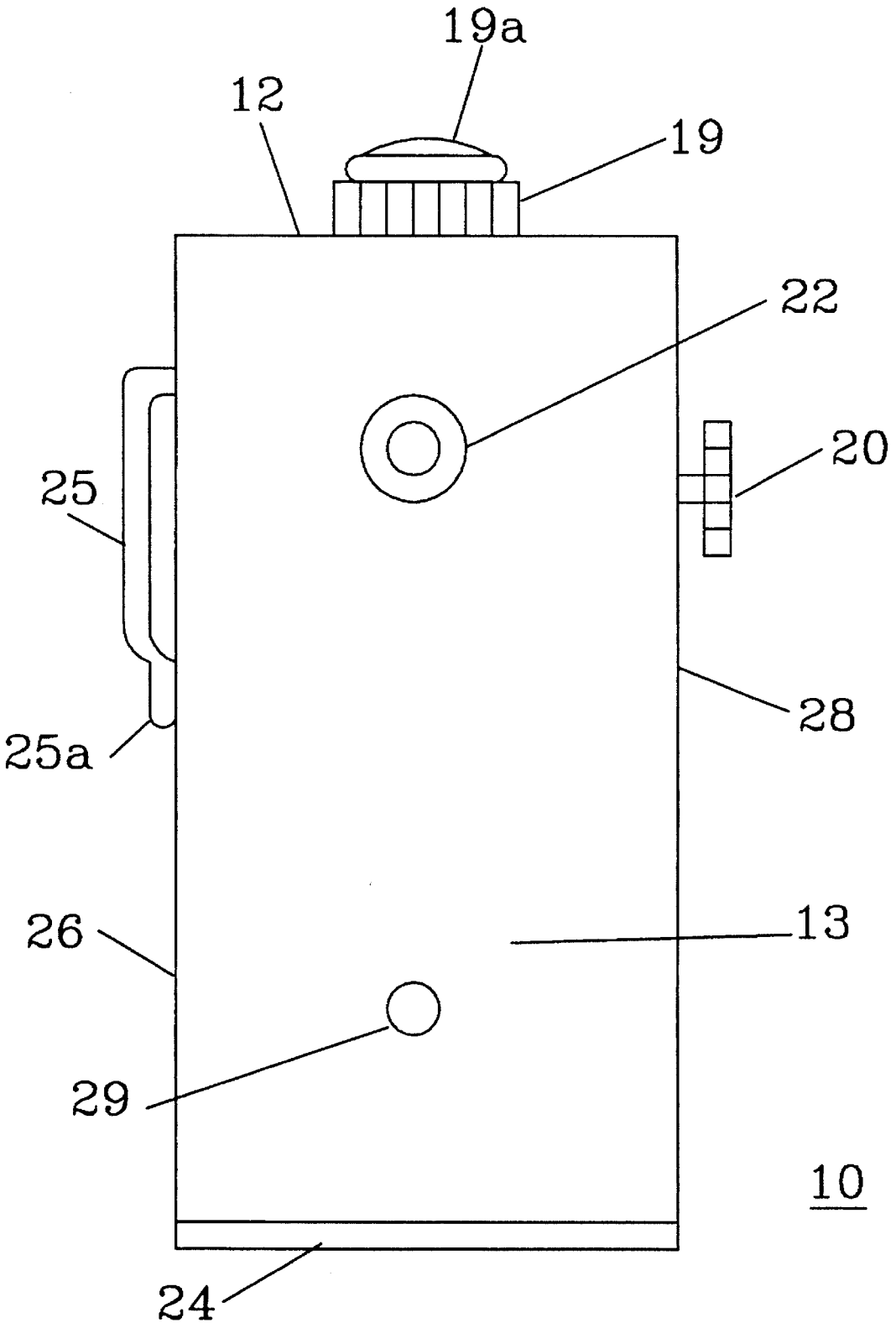
FIG. 2 is a side view of the air storage tank.

FIG. 2 is a side view of tank 10 showing air inlet 22 on side 13, regulator knob 20 and cap 19. On the back side 26 of container 10 is a belt clip 25 for mounting tank 10 on the belt of the person using tank 10. Clip 25 is of a spring type material that holds end **25*a* against back side 26. End 25*a* may be flexed away from back side 26, placed over a belt, and then released to let end 25*a* move back against back side 26**.

Figure 3:
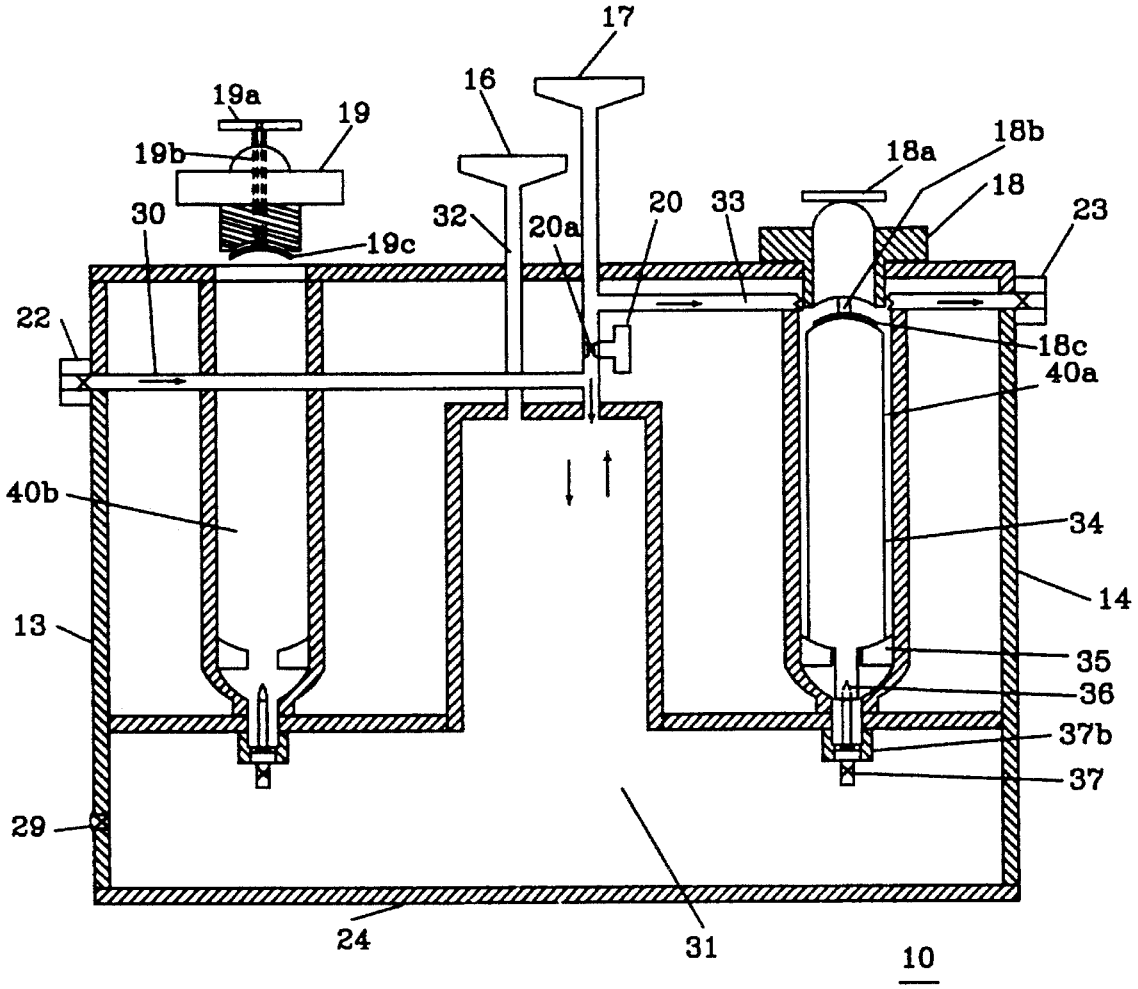
FIG. 3 is a cross-sectional view of the storage tank showing the internal air chambers and air passage ways.

FIG. 3 is a cross sectional view of air storage tank 10 showing the internal structure. Tank 10 has in an inlet 22 that is connected to channel 30 that supplies air to chamber 31. Air flows from chamber 31 into channel 33 and out outlet 23. Pressure gage 16 measures and indicates the air pressure in chamber 31. Air flowing out of chamber 31 flows through regulator **20*a*, which is adjusted by knob 20**.

There are two cartridge chambers **40*a* and 40*b*. Chamber 40*a* has a gas cartridge 34 therein. Cartridge 34 is held in place by cap 18. To discharge the gas from cartridge 34 in to chamber 31, knob 18*a* is screwed or pressed down to move plate 18*c* into engagement with cartridge 34 to force the end of cartridge 34 into needle 36, which punctures the end of cartridge 36, releasing gas through its hollow body. The downward movement of cartridge 34, and/or gas pressure, also opens valve 37 so that the gas from cartridge enters chamber 31. To prevent the gas from escaping upward, cartridge 34, as it moves downward, engages gasket 35 which is of rubber or other flexible sealing material. Gasket 35 prevents the gas from flowing upward into cartridge chamber 40*a*. Cartridge 34 is held in a downward or depressed position until all the gas flows into chamber 31. When button 18*a* is released cartridge 34 moves upward, due to the spring-like action of gasket 35 and valve 37, closing valve 37**.

Knob 19 is identical to knob 18. Knob 19 is screwed down, for example, by threaded shaft **19*b* to move plate 19*c* into engagement with a gas cartridge (not illustrated) in chamber 40*b*. In an alternate design (FIG. 5) knobs 18*a* and 19*a* are push buttons that may be pressed downward to cause gas cylinder 34** to be punctured.

There are two cartridge chambers, 40*a* and 40*b*, either of which or both may be used to supply air/gas to chamber 31 in addition to suppling air though inlet 22. Inlet 22 includes a one way valve or quick disconnect connector such that air input into channel 30 and chamber 31 will not exit through inlet 22, even when there is no connection made to inlet 22. Similarly, outlet 23 utilizes a one way air valve or quick disconnect connector so that air will not escape when there is no connection made to outlet 23.

In side 13 is a safety valve 29 that allows air to escape from chamber 31 in the event the pressure in chamber 31 exceeds a predetermined value, for example 300 psi.

Figure 4:
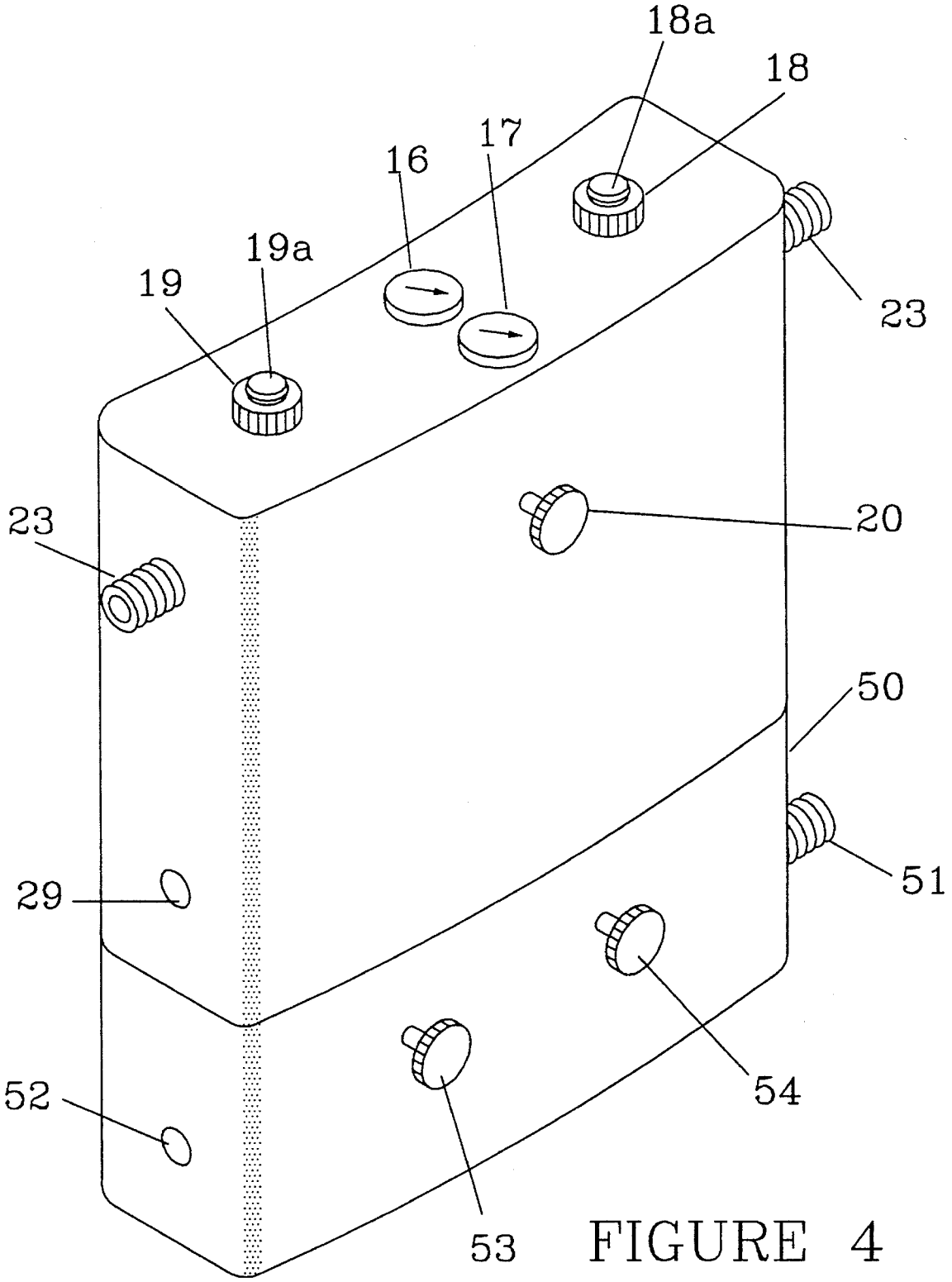
FIG. 4 shows the air storage tank with an auxiliary compartment attached to the bottom.

FIG. 4 shows utility air storage tank 10, of FIG. 1, with an auxiliary tank 50 attached. Tank 50 attaches to the bottom of tank 10 after bottom plate 24, FIG. 1, has been removed. Externally, tan 50 has an inlet/outlet 51, two control knobs 53 and 54, and a vacuum discharge port/valve and filter screen 52.

Figure 5:
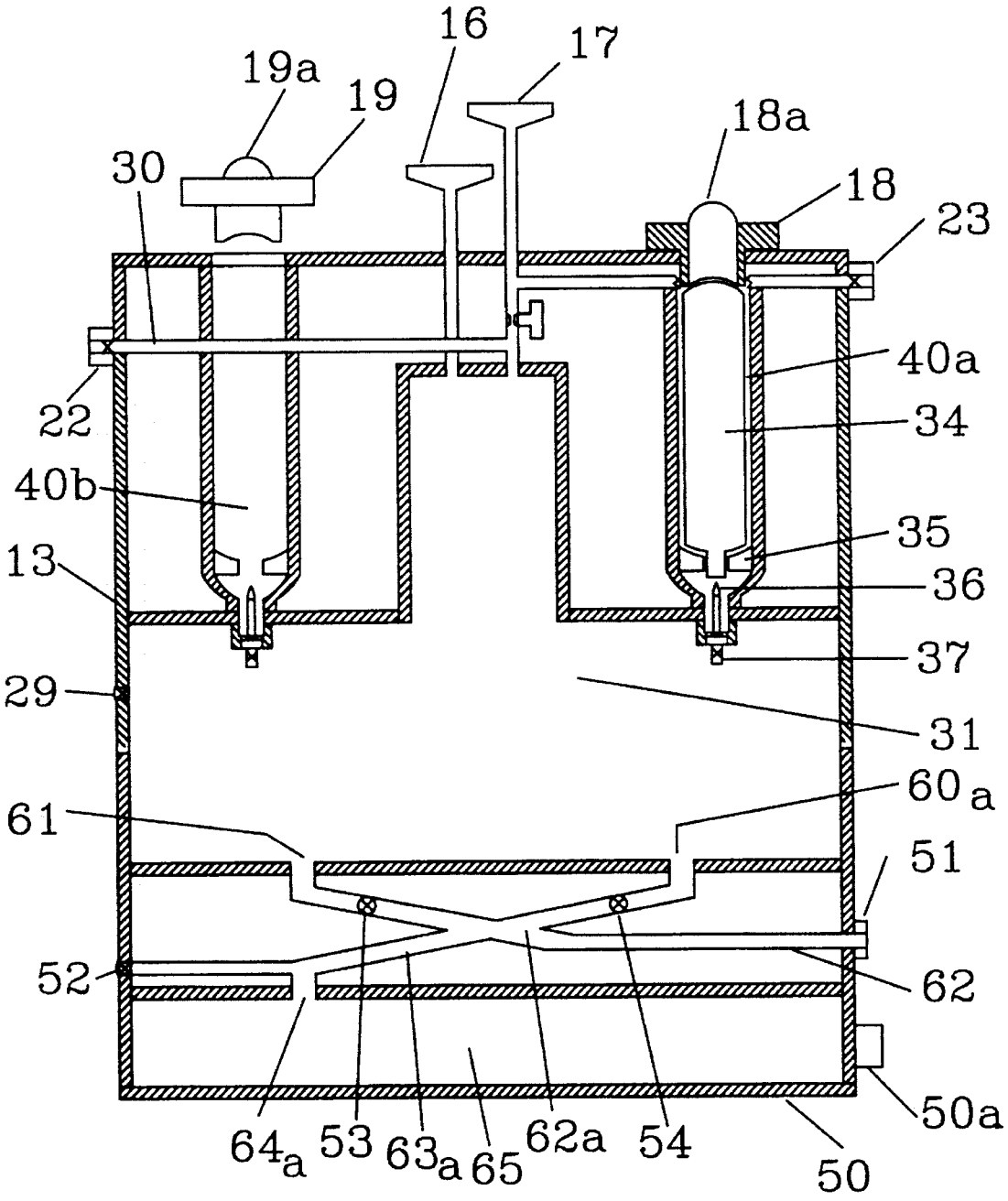
FIG. 5 is a cross-sectional view of the air storage tank and the auxiliary compartment.

FIG. 5 is a cross-sectional view of tank 10 and tank 50 as shown in FIG. 4. Tank 50, depending upon which valve 53, 54 is opened, serves as a sand blast tank or a vacuum tank. When fine particle blasting sand is placed in chamber 65, and valves 52 and 54 are closed, and valve 53 is open, the release of air from chamber 30 through open valve 53 and channel 62 through outlet/inlet 51 to the outside of tank 50 will draw blasting sand up through opening 64*a* into channel 63*a*, and out through channel 62 to outlet 51. In this manner, the apparatus of FIG. 5 may be used to sand blast several square inches of a surface, or may be used to clean, for example, the end of a spark plug.

When valve 54 is open and valve 53 is closed, air released from chamber 31 through opening 60*a* through channel 63 and out valve 52, will produce a vacuum in channel 62 as air passes opening 62*a*. A hosed connected to outlet/inlet 51 will vacuum up dust or a small amount of liquid and deposit it in chamber 65 through opening 64.

Figure 6:
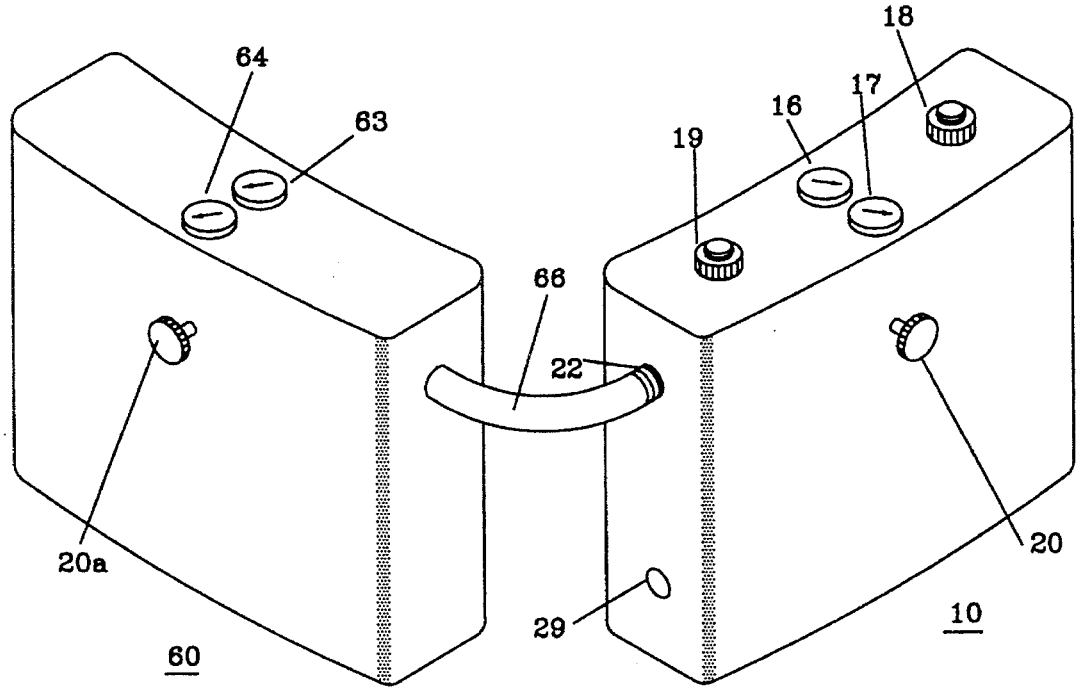
FIG. 6 shows the air storage tank in combination with a secondary air storage tank.

FIG. 6 shows tank 10 with an auxiliary tank 60 connected to inlet 22 by hose 66. Tank 60 also has a pressure gage 63 and regulator gage 64. The air leaving tank 60 is regulated by knob 20*a* in the same manner as knob 20 and regulator valve 20*a* on tank 10. Tank 60, when filled with air, at least doubles the supply of available air since it has more internal volume than tank 10. In the example shown for tank 60, there are no gas cartridge chambers. Therefore, the entire internal volume of tank 60 maybe used for air storage, storing a greater amount of air than tank 10.

Figure 7:
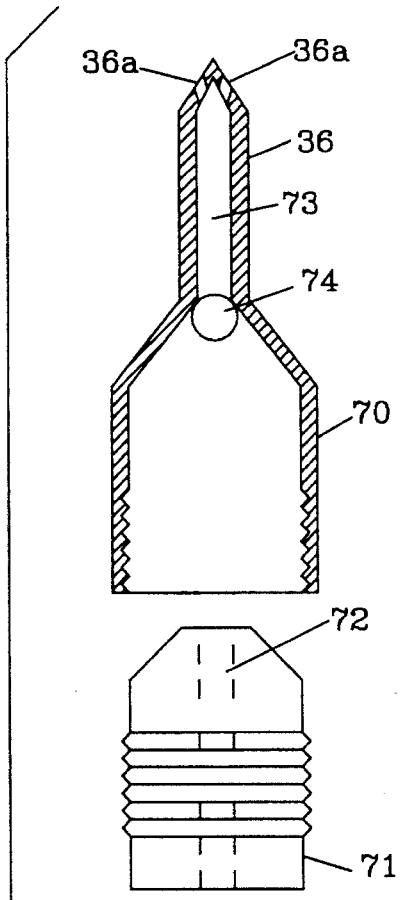
FIGS. 7, 8 and 9 show an example of a one-way valve and needle for supplying gas from a gas cartridge into the air chamber.
Figure 8:
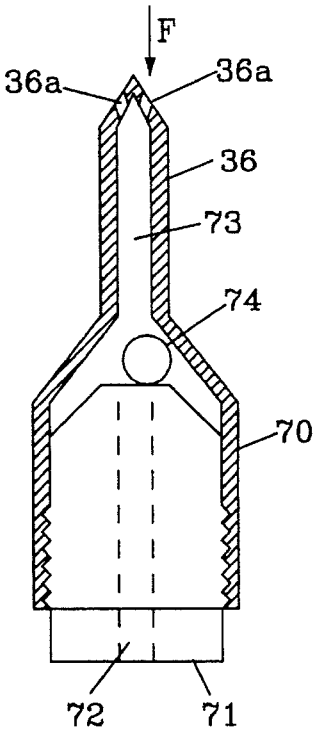
Figure 9:
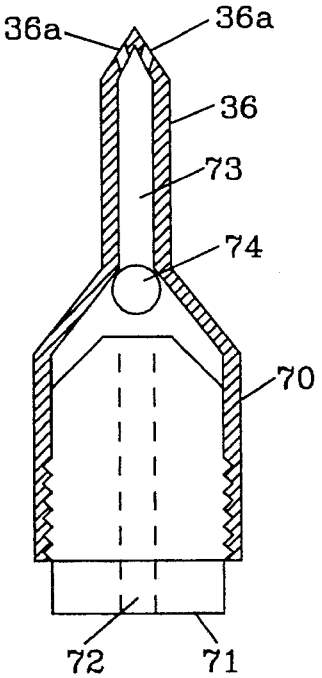

FIGS. 7, 8 and 9 illustrate one example of a one-way valve 37 and and needle 36 as shown in FIG. 3. Hollow needle 36 is an integral part of needle body 70 which may, for example, be mounted in part 37*b* (FIG. 3) a flexible ball 74 is placed in body 70 and end cap 71 is screwed into body 70. An air channel 72–73 is provided though cap 71 and needle 36, respectively. Needle 36 has openings in its end at 36*a*. FIG. 8 shows gas flow F from a gas cartridge into channel 73 via openings 36*a*. The force of the gas flow forces ball 74 downward permitting the gas to flow from channel 73 into channel 72. When the air/gas pressure in air compartment 31 (FIG. 3)becomes greater than the pressure from flow F, then ball 74 is forced upward (FIG. 9) closing channel 73, preventing air to flow out of air compartment 31 into cartridge chamber 40*a*. Residual pressure in 40*a* is released into the atmosphere via hollow center portion of 19*b* and 18*b*.

What is claimed:

1. A utility air storage tank, comprising:

a tank housing having a first inlet and an outlet, said first inlet for introducing air into said air tank housing for storage, and said outlet for removing air from said air tank housing;

an air storage compartment within said tank connected to air channels connecting said first inlet to the air storage compartment and to said outlet;

at least one compartment for mounting a gas cartridge;

a one way valve, disposed in fluid communication, between said at least one compartment and said air storage compartment, including a puncture device for puncturing and channeling gas from one end of said gas cartridge, said one way valve providing a second inlet to said air storage compartment;

a cap for holding said cartridge in said at least one compartment; and a screw-down knob in said cap for forcing said cartridge into said puncture device.

2. The utility air tank according to claim 1; including a first pressure gage for measuring the air pressure within said air storage compartment; and a second pressure gage for measuring the pressure of air leaving said air tank through said outlet.

3. The utility air tank according claim 1, including a pressure regulator between said air storage compartment and said outlet.

4. The utility air tank according to claim 1, in combination with an auxiliary tank attachable to said utility air tank to form a larger air storage compartment and to provide sand-blast and vacuum functions.

5. The utility air tank according to claim 4, wherein said auxiliary tank includes first and second air channels connected with said air storage compartment and with each other and first and second valves for controlling direction of air flow in said air channels.

6. The utility air tank according to claim 4, where in the first valve is in one air channel and said second valve is in a second air channel.

7. The utility air tank according to claim 4, herein said auxiliary tanks includes a combination inlet/outlet port.

8. The utility air tank according to claim 1, including a safety valve in said air storage compartment.

9. The utility air tank according to claim 1, wherein said inlet and outlet are quick disconnect connectors.

10. A utility air storage tank, comprising:

a tank housing having a first inlet and an outlet, said first inlet for introducing air into said air tank housing for storage, and said outlet for removing air from said air tank housing;

an air storage compartment within said tank connected to air channels connecting said first inlet to the air storage compartment and to said outlet;

at least one compartment for mounting a gas cartridge;

a one way valve, disposed in fluid communication between said at least one compartment and said air storage compartment, including a puncture device for puncturing and channeling gas from one end of said gas cartridge, said one way valve providing a second inlet to said air storage compartment;

a cap for holding said cartridge in said at least one compartment;

a screw-down knob in said cap for forcing said cartridge into said puncture device;

a regulator valve for regulating the air flow out of said air storage compartment through said outlet;

a first gage for measuring the air pressure in said air storage compartment; and a second gage for measuring the air pressure set by said regulator valve.

11. The utility air tank according to claim 10, in combination with an auxiliary tank attachable to said utility air tank to form a larger air storage compartment and to provide sandblast and vacuum functions.

12. The utility air tank according to claim 11, wherein said auxiliary tank includes first and second air channels connected with said air storage compartment and with each other and first and second valves for controlling direction of air flow in said air channels.

13. The utility air tank according to claim 11, where in the first valve is in one air channel and said second valve is in a second air channel.

14. The utility air tank according to claim 11, herein said auxiliary tanks includes a combination inlet/outlet port.

15. The utility air tank according to claim 10, including a safety valve in said air storage compartment.

16. The utility air tank according to claim 10, wherein said inlet and outlet are quick disconnect connectors.

17. The utility air tank according to claim 10 wherein said one way valve between said at least one compartment and said air storage compartment, including a puncture device for puncturing one end of said gas cartridge. Includes an orifice and ball, wherein said ball seals said orifice from pressure in said air storage compartment, and permits air into said air storage compartment when gas from said gas cartridge moves said ball away from said orifice.

* * * * *